US007436931B2

(12) United States Patent
Harding

(10) Patent No.: US 7,436,931 B2
(45) Date of Patent: Oct. 14, 2008

(54) X-RAY SOURCE FOR GENERATING MONOCHROMATIC X-RAYS

(75) Inventor: Geoffrey Harding, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 162 days.

(21) Appl. No.: 10/538,525

(22) PCT Filed: Dec. 3, 2003

(86) PCT No.: PCT/IB03/05649

§ 371 (c)(1),
(2), (4) Date: Jun. 10, 2005

(87) PCT Pub. No.: WO2004/053919

PCT Pub. Date: Jun. 24, 2004

(65) Prior Publication Data

US 2006/0115051 A1 Jun. 1, 2006

(30) Foreign Application Priority Data

Dec. 11, 2002 (EP) ..... 02080248
Oct. 6, 2003 (EP) ..... 03103685

(51) Int. Cl.
*H01J 35/12* (2006.01)
*H01J 35/08* (2006.01)

(52) U.S. Cl. ..... 378/143; 378/130; 378/141; 378/200

(58) Field of Classification Search ..... 378/141, 378/143, 144, 130, 200
See application file for complete search history.

(56) References Cited

U.S. PATENT DOCUMENTS 3,683,223 A * 8/1972 Dietz ..... 378/125
4,075,526 A * 2/1978 Grubis ..... 378/124
4,130,772 A * 12/1978 Kussel et al. ..... 378/144
4,130,773 A * 12/1978 Kussel ..... 378/123
4,238,706 A * 12/1980 Yoshihara et al. ..... 378/34

(Continued)

FOREIGN PATENT DOCUMENTS

DE 27 19 609 A1 11/1978

(Continued)

*Primary Examiner*—Edward J Glick
*Assistant Examiner*—Thomas R Artman
(74) *Attorney, Agent, or Firm*—Larry Liberchuk

(57) ABSTRACT

The present invention relates to an X-ray source comprising an electron source (1) for the emission of electrons (E), a target (4) for the emission of characteristic, substantially monochromatic X-rays (C) in response to the incidence of the electrons (E) and an outcoupling means (11) for outcoupling of the X-rays. To achieve characteristic, substantially monochromatic X-rays with a high power loadability electrons are incident on a metal foil (5) of a thickness of less than 10 μm and a base arrangement (7, 12) is arranged wherein the metal of said metal foil (5) has a high atomic number allowing the generation of X-rays (C) and the material substantially included in the base arrangement (7, 12) has a low atomic number not allowing the generation of X-rays (C). The outcoupling means are adapted for outcoupling only X-rays (C) on the side of the metal foil (5) on which the electrons (E) are incident and which is opposite to the side of the base arrangement (7, 12) since on this side almost no bremsstrahlung radiation is generated.

15 Claims, 3 Drawing Sheets

Figure 1:
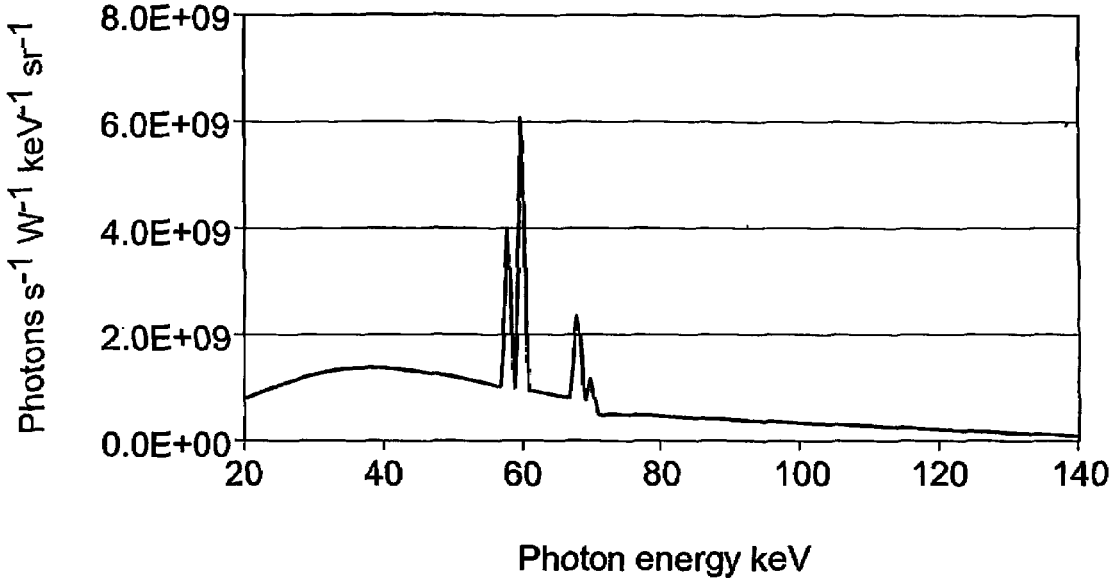

U.S. PATENT DOCUMENTS 4,477,921 A * 10/1984 Armini et al. ..... 378/34
4,622,687 A * 11/1986 Whitaker et al. ..... 378/130
5,602,899 A * 2/1997 Larson ..... 378/143
5,627,871 A * 5/1997 Wang ..... 378/121
5,682,412 A * 10/1997 Skillicorn et al. ..... 378/98.6
6,078,644 A * 6/2000 Day et al. ..... 378/144
6,185,277 B1 2/2001 Harding
6,282,263 B1 * 8/2001 Arndt et al. ..... 378/138
6,947,522 B2 * 9/2005 Wilson et al. ..... 378/125
2006/0233307 A1 * 10/2006 Dinsmore ..... 378/136

FOREIGN PATENT DOCUMENTS

EP 0 432 568 A2 6/1991
EP 0 584 871 A1 3/1994

* cited by examiner

X-RAY SOURCE FOR GENERATING MONOCHROMATIC X-RAYS

The present invention relates to an X-ray source comprising an electron source for the emission of electrons, a target for the emission of X-rays in response to the incidence of the electrons and an outcoupling means for outcoupling the X-rays. Further, the present invention relates to a target for use in such an X-ray source.

An X-ray source of this kind based on the production of bremsstrahlung radiation in a turbulently-flowing liquid metal, also called LIMAX (Liquid Metal Anode X-ray source), is described in U.S. Pat. No. 6,185,277. The electrons enter the flowing liquid via an electron window which is a metal foil, for instance made of molybdenum or tungsten, or a diamond membrane. The electron window is sufficiently thin, in particular a few μm, so that the electron beam loses only a small portion of its initial energy in the window.

It is the object of the present invention to provide an X-ray source and a target for use in such an X-ray source which allows the generation of substantially monochromatic X-rays, by which a significant dose reduction can be achieved and which permits a higher power loadability compared to known X-ray sources.

This object is achieved according to the present invention by an X-ray source as claimed in claim 1 comprising:

an electron source for the emission of electrons, a target for the emission of characteristic, substantially monochromatic X-rays in response to the incidence of the electrons, said target comprising a metal foil of a thickness of less than 10 μm and a base arrangement for carrying said metal foil, wherein the metal of said metal foil has a high atomic number allowing the generation of X-rays and the material substantially included in the base arrangement has a low atomic number not allowing the generation of X-rays, and an outcoupling means for outcoupling the X-rays on the side of the metal foil on which the electrons are incident and which is opposite to the side of the base arrangement.

A corresponding target for use in such an X-ray source is defined in claim 14.

The present invention is based on the idea to provide a discrete line X-ray source based on electron impact of a thin metal foil carried by a base arrangement. The basic idea is to discriminate against the bremsstrahlung radiation by observing the radiation emitted on the side of the target on which the electrons are incident, i.e. the radiation which is essentially antiparallel to the initial electron beam direction. The metal foil constituting the electron window is made sufficiently thin to preserve to a certain extent the angular collimation of the electron beam incident on the foil. The foil thickness is less than the electron diffusion depth; hence, a significant portion of the electron beam is deposited directly in the base arrangement. Whether this is a good assumption in a particular situation can only be ascertained by a simulation of the electron-photon transport, for instance a Monte-Carlo simulation. The power loadability of the proposed X-ray source is thus much greater than that of known stationary anode X-ray sources.

Preferred embodiments of the invention are defined in the dependent claims. While the invention generally works with a metal foil having a thickness of less than 10 μm, the best results are obtained if the metal foil has a thickness of less than 5 μm, preferably between 1 and 3 μm.

Furthermore, the metal foil is generally made of a metal which allows the generation of X-rays in response to the incidence of electrons. The choice of the material for the metal foil is dictated by the required photon energy in the emitted X-ray beam. All metals with $20 \leqq Z \leqq 90$, Z being the atomic number, are potential candidates, although metals with high mechanical strength, high melting point and ease of bonding technology with the base arrangement are favored. Preferred materials have an atomic number between 40 and 80. Good candidate materials are for instance tungsten, molybdenum or gold.

According to a preferred embodiment the base arrangement comprises a cooling circuit arranged to allow a coolant to flow along the side of said metal foil opposite to the side on which the electrons are incident, i.e. the metal foil is cooled by a flowing water beam dump. To aid optimization of the design parameters of the known LIMAX arrangement, a simple approach has been taken to determine the maximum focus temperature in dependence on such parameters of the liquid metal as the electron range, its diffusivity, flow velocity and degree of turbulence. The diffusion model yields results which are in relatively good agreement with those of a finite element program.

In the course of varying the input parameters to the above diffusion model the unexpected result was obtained that the thermal transport in a water-cooled arrangement leads to a factor of 10 increase in power loadability at constant focus temperature relative to the best liquid metal candidate. In quantitative terms, a focus of dimensions 1 mm×10 mm could be loaded with an electron beam power of several tens of kW without exceeding the boiling point of water. This is exploited in this proposed embodiment of the X-ray source to obtain the high power loadability of the metal foil target by using a coolant having a low atomic number avoiding the generation of X-rays therein.

While generally the coolant has a low atomic number preventing the generation of X-rays in response to the incidence of electrons, the atomic number is preferably less than 10. Such liquids include water as well as oils based on hydrocarbon compounds. A high power loadability of the X-ray source has been, obtained by using water as a coolant.

To achieve a high flow velocity of the coolant in the area of the metal foil, a cooling circuit in which the coolant is flowing comprises a constriction in this area. Thus, a good cooling of the metal foil can be obtained and boiling of the coolant is prevented.

According to another preferred embodiment the target comprises a carrier supporting the metal foil on the side facing the coolant. Due to the very low thickness of the metal foil, depending on the material of the metal foil, it can be necessary to support it in order to increase mechanical stability. In this case an appropriate carrier, for instance a thin diamond layer, can be provided.

For some medical applications of monochromatic X-rays in diagnostic radiology it is necessary to have a source of high radiance, and therefore high pulse power, for a short exposure time (≦1 sec.). In a preferred embodiment of the present invention a rotating anode tube geometry is used in which the base arrangement comprises a rotatable base plate of a material having an atomic number of less than 10, in particular in the range from 4 to 6. The base plate serves the functions of supporting the thin metal foil and, when it is rapidly rotated, of removing by convection the electron energy deposited directly in the base arrangement. The short term power loadability of this rotating anode arrangement is at least a factor of ten greater than that of the embodiment comprising a cooling circuit, as the combination of the metal foil and base plate can be operated at a much higher track speed and at a much higher temperature than the embodiment comprising the cooling circuit. Therefore, this embodiment is a significant step towards a realistic monochromatic X-ray source for diagnostic radiology.

To avoid including bremsstrahlung radiation in the X-ray beam an outcoupling means, such as an X-ray window transparent to X-rays, is provided which generally only transmits X-rays propagating in the reflection direction of the metal foil, i.e. no X-rays in the transmission direction are outcoupled. In a preferred embodiment the outcoupling means only transmits X-rays propagating in a certain angular range from the reflection direction as defined in claim 10. This ensures that almost only characteristic monochromatic X-rays are outcoupled since bremsstithlung radiation almost completely propagates in the transmission direction but neither in the reflection direction, nor in said angular range.

According to another embodiment the outcoupling means is adapted to outcouple X-rays in a direction substantially antiparallel to the direction of incidence of said electrons, in particular in a direction at an angle in the range from 150° to 210° to the direction of incidence of said electrons.

According to still another preferred embodiment the electrons are directed onto the surface of the metal foil at an angle of substantially 90°, i.e. perpendicular to the surface. In this direction the highest efficiency of producing X-rays can be ensured. However, to avoid the outcoupled X-ray beam obstructed by the electron source, the electron source is preferably located outside the X-ray beam, i.e. at an angle different from 90° to the surface of the metal foil. To ensure that the electrons hit the metal foil at an angle of substantially 90°, appropriate means for directing the electron beam, for instance appropriate deflection coils, are provided.

Figure 2:
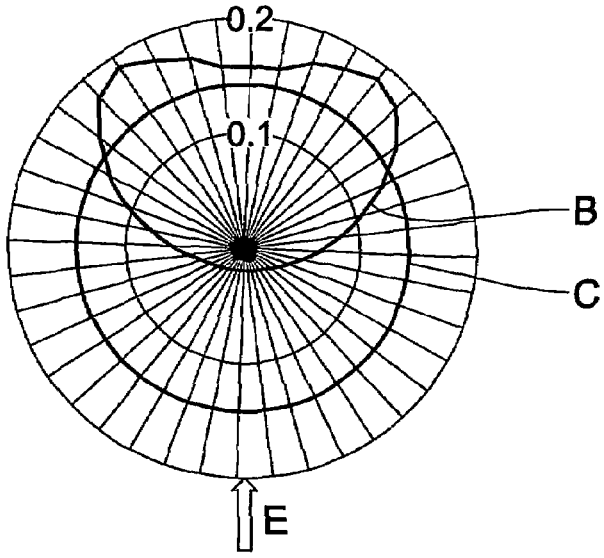
Figure 3:
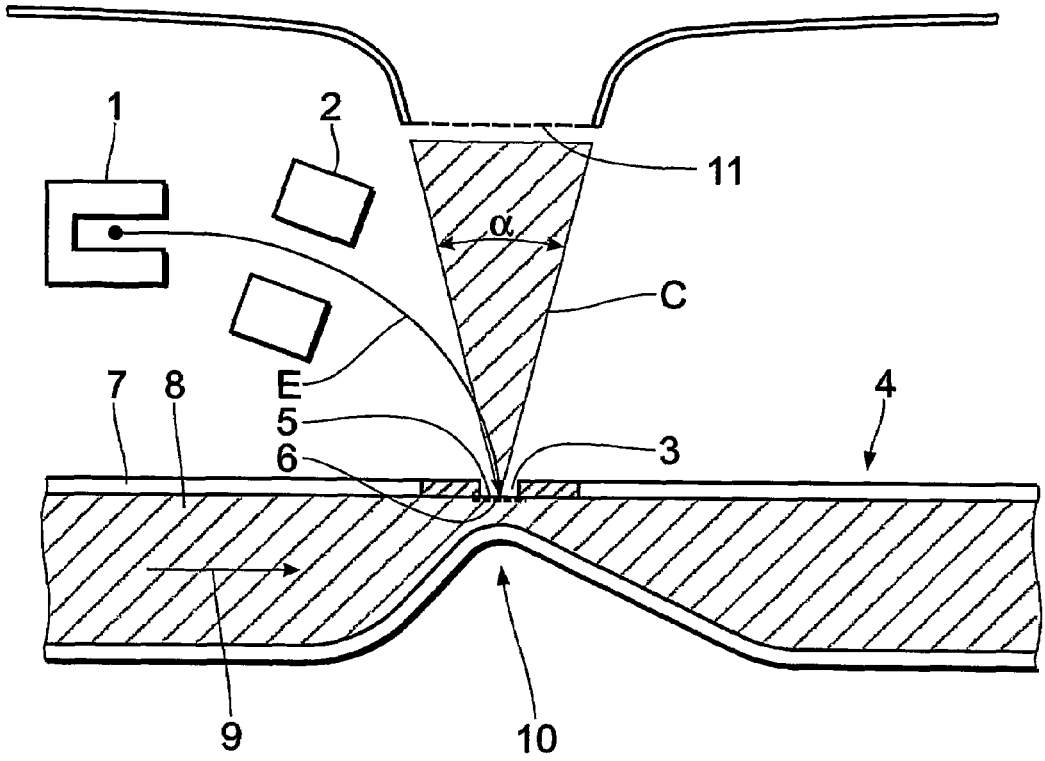
Figure 4:
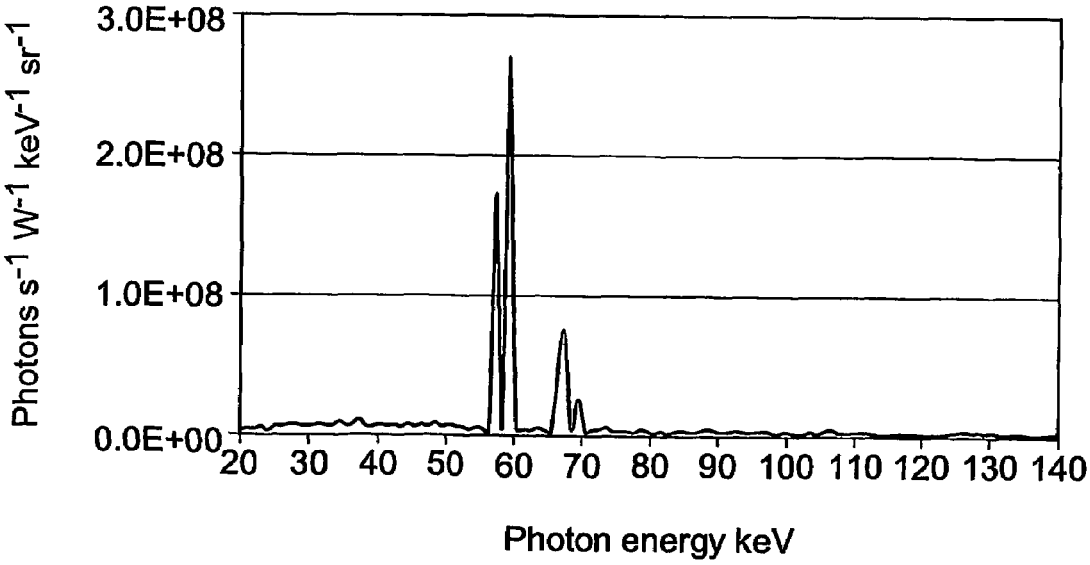
Figure 5:
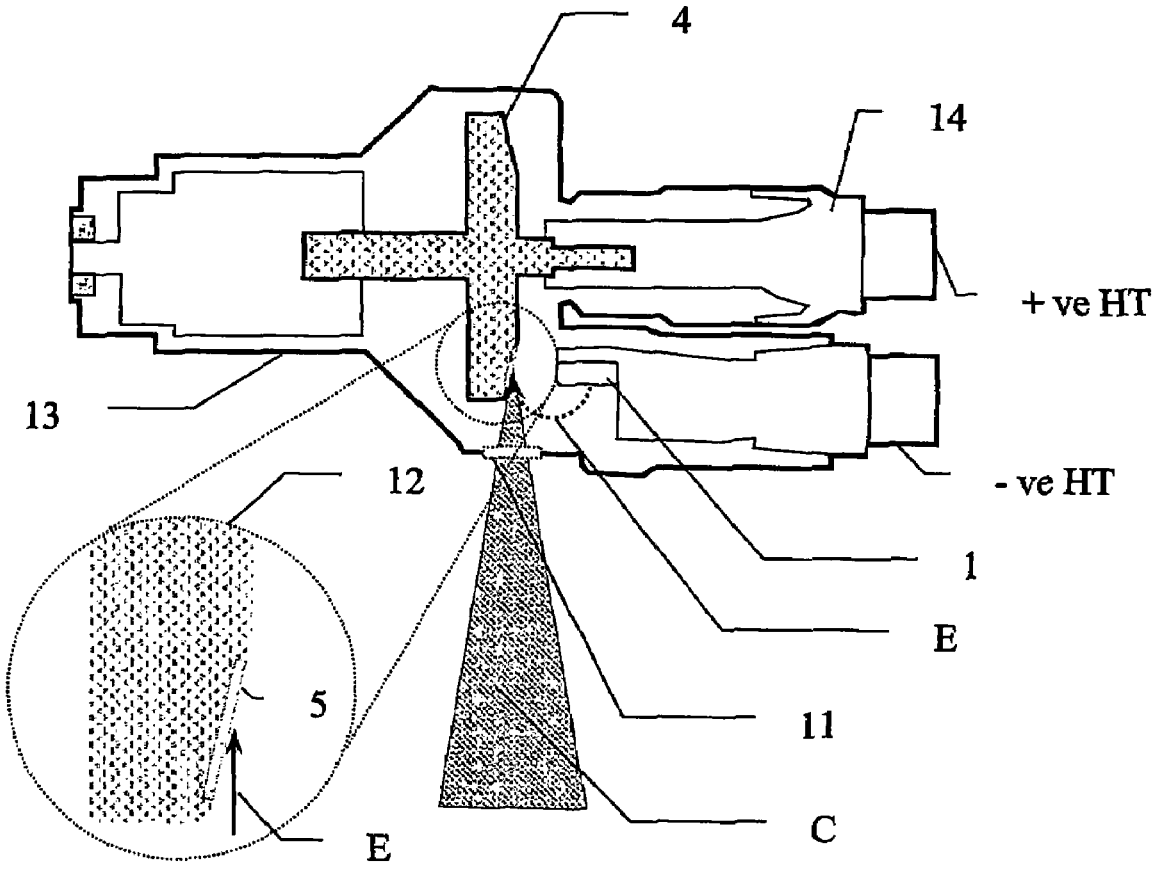

The present invention will now be explained in more detail with reference to the drawings in which FIG. 1 shows the photon spectrum of a thick target of a known X-ray tube, FIG. 2 shows a polar plot of X-ray radiation from a thin W target, FIG. 3 shows a first embodiment of an X-ray source according to the present invention comprising a cooling circuit, FIG. 4 shows a photon spectrum of a thin target according to the present invention and FIG. 5 shows a second embodiment of an X-ray source according to the present invention having a rotating anode tube geometry.

FIG. 1 shows the photon spectrum of a known X-ray tube having a target with a massive W anode in response to a 150 keV electron beam using a 2 mm Al filter and a 10° anode angle. The ratio of photons in the almost discrete K lines to the total number of photons in the spectrum is a measure for the monochromaticity M of the X-ray source. For the benefit of comparison with the X-ray source of the present invention the value of M for the spectrum shown in FIG. 1 is about 10%. It is well known that electron diffusion makes a non-negligible contribution to the thermal transport in X-ray tube anodes. This contribution increases in solid-state, e. g. rotating anode X-ray tubes the shorter the time that the heat pulse has to diffuse through the target medium. The electron diffusion component can dominate the thermal transport when the anode has a relatively low conductivity. This is the case in a liquid anode tube when the anode consists of a coolant having a low atomic number rather than a liquid metal having a high atomic number. Very high values of loadability, i.e. power loading per unit area of focus leading to unit temperature rise in the anode (loadability having a unit of W $mm^{-2}$ $K^{-1}$) can be achieved by this. A loadability for a liquid water anode of 50 W $mm^{-2}$ $K^{-1}$ is feasible, and this is significantly higher than the maximum obtainable loadability with the known liquid metal anodes.

It is also established that the angular distribution of bremsstrahlung radiation is highly anisotropic for relativistic electron beams, with a marked preference for X-ray emission in the forwards direction. This situation is illustrated in FIG. 2 showing a polar plot of bremsstrahlung intensity B for 128 keV electrons on free W atoms. The atom is assumed to be at the center of the plot and the electron beam propagates vertically upwards as indicated by the arrow E. The intensity is proportional to the vector length from the center to the curve. The angular distribution of characteristic radiation C is also shown. As can be seen the angular distribution is isotropic, i.e. the intensity of characteristic radiation is substantially equal in all directions including the direction antiparallel to the direction of the electron beam E. The cross sections for photon production are differential in photon energy and emission angle.

These considerations together have led to the idea of a discrete line X-ray source based on electron impact on a thin metal foil cooled by a flowing coolant beam dump, where the coolant is particularly water. A first embodiment of an X-ray source according to the present invention is shown in FIG. 3. An electron source 1, for instance a cathode, emits an electron beam E which under the influence of an external magnetic field generated by coils 2 rotates to enter the electron window 3 of the target 4 vertically. The electron window 3 comprises a thin metal foil 5 of a material whose K lines are to be excited, supported if necessary by a thin carrier 6 of e. g. diamond.

The target 4 further comprises a cooling circuit 7 which can be a hollow tube in which a coolant 8 flows in the direction of the arrow 9. In order to increase the flow velocity of the coolant 8 in the area at the electron window 3, in particular under the metal foil 5, the cooling circuit 7 comprises a constriction 10 in this area, i.e. the cross section of the cooling circuit 7 is reduced compared to the cross section in other areas.

The thickness of the metal foil 5 is smaller than or equal to the electron diffusion depth, which is the depth at which the energy loss per unit length projected on the incidence direction of the electron beam E has its maximum value. It can be estimated from empirical formulae, or rather derived from Monte-Carlo programs for the electron transport. For 150 keV electrons incident on W foils its value is approximately 4 μm. Selecting the thickness of the metal foil smaller than or equal to the electron diffusion depth ensures that the electron velocity vectors will not have had opportunity to become isotropically distributed in direction. In practice the thinness of the metal foil implies that less than 20% of the electron energy is deposited in the foil 5 or, correspondingly, that more than 80% of the energy is deposited in the coolant 8.

The range of electrons of this energy is in tungsten approximately 20 μm from which it is evident that a significant proportion of the total electron energy will be deposited directly in the coolant. To a first approximation, the volume of coolant bombarded by electrons per second is V R L, where V is the flow speed of the coolant 8 in the constriction 10, L is the length of the electron focus perpendicular to the plane of the drawing of FIG. 3 and R is the electron range in water which is preferably selected as a coolant. Hence the amount of energy this volume of water can take up per second for temperature rise $\Delta T$ is $V R L \Delta T C_p$, where the last factor is the heat capacity of water (4.2 MJ $m^{-3}$ $K^{-1}$). It has been assumed that the energy loss per unit length projected on the incidence direction of the electron beam E is constant over the electron range. Inserting the values $V=50\ m\ s^{-1}$, $R=250\ \mu m$, $L=10^{-2}\ m$, $\Delta T=25°$ leads to a power of approximately 10 kW.

On the basis of the condition described above a foil thickness of less than 5 μm, preferably between 1 and 3 μm, for instance 2 μm, is assumed. Approximately 5% of the total power (about 1 kW) will be deposited in the foil 5. A temperature rise of $\Delta T=50°$ is sufficient to remove this heat load with a water flow speed given above.

As the assumed coolant has a low mean atomic number Z and the cross section for production of bremsstrahlung is proportional to Z there will be comparatively little X-ray production in the coolant.

The electrons penetrating through the foil 5 interact either by collisional excitation to ionize the foil material or more occasionally through production of bremsstrahlung. The former involves the K shell electrons if the incoming electron has sufficient energy. The excited atom returns to its ground state by the emission of characteristic radiation e. g. with energy ($K_{\alpha 1}$ line) of 57 keV. Characteristic radiation is emitted isotropically. The latter effect, bremsstrahlung radiation, is emitted almost completely in the direction of transmission, i.e. in the downward direction in FIG. 3, while the intensity of bremsstrahlung emission in the direction of reflection, i.e. in the upward direction in FIG. 3, particularly in the direction perpendicular to the surface of the metal foil 5, is very low.

Hence, if the foil emission is observed in the direction of reflection, in particular over an angular range α of, preferably ±20° antiparallel to the direction of the electron beam, by use of appropriate outcoupling means 11, e.g. a window transparent to X-rays, it will be composed of a background of low intensity bremsstrahlung from the coolant 8 on which the characteristic lines of the metal of the foil 5 are superimposed. This results in a quasi-monochromatic spectrum of high radiance C. Monochromatic radiation is useful in a number of areas of medical and scientific radiology including, but not limited to investigations with reduced patient dose, calibration of detectors and development of new diagnostic modalities.

The mean energy loss by the electron beam E in the foil is approximately given by the Thomson-Whiddington-law which is itself derived from the Bethe-Bloch energy loss relationship. The Thomson-Whiddington-law is: $E^2=E_0^2-xb\rho$. $E_0$ is the initial electron energy and x is the foil thickness in the initial direction of the electron beam required to reduce the mean electron energy to E. The other symbols have their customer meanings.

The Thomson-Whiddington constant b has a value for tungsten of $8\cdot10^4\ keV^2m^2kg^{-1}$ at 150 keV. This results in an energy loss per μm foil thickness of 5 keV for thicknesses which are small compared with the electron range. The electron range is the value of foil thickness x required to reduce E to zero and is approximately 20 μm from this equation.

A simulation result of the back-directed X-rays from the embodiment of the X-ray source shown in FIG. 3 having a 2 μm thick W foil irradiated with 150 keV electrons is represented in FIG. 4. The spectrum shows the radiation emitted in a cone of opening semiangle 15° in a direction antiparallel to the initial electron beam direction. The monochromaticity parameter M defined above has a value of 0.45 for this arrangement and can be improved further by optimizing the geometry, high voltage and filtering.

FIG. 5 shows another embodiment of the present invention having a rotating anode tube geometry in which the anode (i.e. the target) 4 is rotated. The design of this embodiment is taken from a dual-pole tube, i.e. the tube housing 13 is insulated from both cathode and anode HT via insulators 14, as this design is most widespread in medical X-ray tubes for short pulse exposures. The design is independent of the relative bias of the tube housing and anode, however, and can as easily be realized with a single pole X-ray tube.

Referring to FIG. 5, a high voltage electrode supplies the cathode 1 with the necessary negative bias and current for the (e. g. thermionic emission) electron emitter. Through the action of an electrostatic or electromagnetic beam deflection device (not shown), an electron beam E is incident vertically upwards on the positively biased anode 4 in the customary way. The shape of the anode 4 and other details of the X-ray tube design (insulators, cathode, bearings etc.) are well known to those familiar with electron impact X-ray tube technology and will hence not be discussed any further here.

The region of impact of the electron beam E at the anode 4 is shown in more detail in the magnified inset to FIG. 5. The thin metal film 5 of material (e. g. W, Mo etc.) whose K characteristic radiation is to be excited is deposited on an anode base material 12. The metal film 5 has a thickness T, where $T \leqq D$, D being the electron diffusion depth.

Opposite to the anode 4 in the tube housing 13 is the exit window 11 of the X-ray tube which is arranged to select only that radiation from the anode 4 which is emitted antiparallel ($160° \leqq \theta \leqq 180°$) to the electron beam direction of incidence. As described for the first embodiment, this selection, together with the condition on the film thickness T, ensures that the X-ray beam consists predominantly of the quasi-monochromatic K characteristic lines of the metal film 5.

The material of anode base plate 12 should have low Z, to absorb electron energy without producing bremsstrahlung X-rays. Materials with a high melting point, high thermal conductivity and a high thermal capacity are advantageous. Two obvious candidates for the anode base plate 12 are beryllium (Be) and graphite (C). The latter is in any case widely used in X-ray tubes which have a high heat storage capacity on account of their good thermal conductivity ($150\ W\ m^{-1}\ K^{-1}$) and high specific heat of $700\ J\ kg^{-1}\ K^{-1}$.

The combination W film on a graphite has been investigated and is apparently stable to temperatures higher than 1000° C. Metal films can also be deposited (e. g. by electroplating) on Be although there seems to be a problem with diffusion into the Be at high temperatures. A platinum (Pt) buffer layer of 0.1 μm thickness between the metal film 5 and the anode base plate 12 may be necessary.

The power loadabihty of the arrangement of FIG. 5 is analogous to that performed above in connection with the description of FIG. 3. when the thermophysical parameters of the coolant are replaced by those of the anode base material. Use of the values $V=50\ m\ s^{-1}$, $R=100\ \mu m$, $L=10^{-2}\ m$, $\Delta T=1000°$ C., with $C_p=700\ J\ kg^{-1}\ K^{-1}$ and $\rho=2500\ kg\ m^{-3}$ (graphite) leads to an instantaneous power on a cold anode of ~100 kW for a 1 $mm^2$ focus. The loadability will obviously decrease as the graphite base warms up. The extent to which this occurs depends on design details of the graphite base e. g. its thickness (parallel to the axis of rotation of the anode) and the diameter of the anode.

The invention claimed is:

1. An X-ray source comprising:

an electron source for emission of electrons in an electron beam, a target for emission of characteristic, substantially monochromatic X-rays in response to incidence of the electrons of the electron beam onto said target, said target comprising a metal foil of a thickness of between one and three μm and a base arrangement for carrying said metal foil, wherein the metal foil thickness of between one and three μm is smaller than or equal to an electron diffusion depth and for which less than twenty percent (<20%) of electron energy is deposited in the metal foil, wherein the metal of said metal foil has a high atomic number allowing the generation of high intensity bremsstrahlung X-rays in a direction of transmission of the electron beam and generation of low intensity bremsstrahlung X-rays in a direction of reflection from said target and the material substantially included in the base arrangement has a low atomic number not allowing the generation of X-rays, and an outcoupling means, which generally only transmits X-rays propagating in the reflection direction of the metal foil over an angular range of ±20° antiparallel to the incident direction of the electron beam, for outcoupling a background of the low-intensity bremsstrahlung X-rays on which quasi-monochromatic characteristic lines of the metal foil are superimposed resulting in a quasi-monochromatic spectrum of X-rays on the side of the metal foil on which the electrons are incident and which is opposite to the side of the base arrangement.

2. The X-ray source as claimed in claim 1, wherein said base arrangement comprises a cooling circuit arranged to allow a coolant to flow along the side of said metal foil opposite to the side on which the electrons are incident, further wherein as a result of the metal foil thickness being smaller than or equal to the electron diffusion depth, more than eighty percent (>80%) of the electron energy is deposited directly into the coolant without exceeding the boiling point of the coolant.

3. The X-ray source as claimed in claim 2, wherein the coolant has a mean atomic number of less than 10.

4. The X-ray source as claimed in claim 2, wherein the coolant is water.

5. The X-ray source as claimed in claim 2, wherein said cooling circuit comprises a constriction in the area of the metal foil.

6. The X-ray source as claimed in claim 2, wherein said target further comprises a carrier of low atomic number material supporting the metal foil on the side facing the coolant.

7. The X-ray source as claimed in claim 1, wherein the metal of said metal foil has an atomic number between 40 and 80.

8. The X-ray source as claimed in claim 1, wherein said outcoupling means is adapted to outcouple X-rays at angles of an angular range from substantially 70° to 110°, to the surface of the metal foil.

9. The X-ray source as claimed in claim 1, wherein said electrons are directed onto the surface of said metal foil at a substantially 90° angle.

10. The X-ray source as claimed in claim 1, wherein said electron source is located outside the X-ray beam to be outcoupled, said X-ray source further comprising means for directing the electron beam onto the metal foil.

11. The X-ray source as claimed in claim 1, wherein said outcoupling means is adapted to outcouple X-rays in a direction at an angle in the range from 160° to 180° to the direction of incidence of said electrons.

12. A target for use in an X-ray source for the generation of characteristic, substantially monochromatic X-rays in response to the incidence of electrons in an electron beam, said target comprising a metal foil of a thickness of between one and three μm and a base arrangement for carrying said metal foil, wherein the metal foil thickness of between one and three μm is smaller than or equal to an electron diffusion depth and for which less than twenty percent (<20%) of electron energy is deposited in the metal foil, wherein the metal of said metal foil has a high atomic number allowing the generation of high intensity bremsstrahlung X-rays in a direction of transmission of the electron beam and generation of low intensity bremsstrahlung X-rays in a direction of reflection from said target and the material substantially included in the base arrangement has a low atomic number not allowing the generation of X-rays, and wherein said base arrangement comprises a rotatable base plate of a material having an atomic number of less than 10, further wherein a background of the low-intensity bremsstrahlung X-rays on which quasi-monochromatic characteristic lines of the metal foil are superimposed results in a quasi-monochromatic spectrum of X-rays produced on the side of the metal foil on which the electrons are incident and which is opposite to the side of the base arrangement.

13. An X-ray source comprising:

an electron source for emission of electrons in an electron beam, and a target for emission of substantially monochromatic X-rays in response to incidence of the electrons of the electron beam onto said target, said target comprising a metal foil of a base arrangement, said metal foil of a thickness of between one and three μm, wherein the metal foil thickness is smaller than or equal to an electron diffusion depth and for which less than twenty percent (<20%) of electron energy is deposited in the metal foil, said metal foil allowing the generation of high intensity bremsstrahlung X-rays in a direction of transmission of the electron beam and generation of low intensity bremsstrahlung X-rays in a direction of reflection from said target and the base arrangement not allowing the generation of X-rays, wherein said base arrangement comprises a cooling circuit to allow a coolant to flow along the side of said metal foil opposite to the side on which the electrons are incident, further wherein as a result of the metal foil thickness being smaller than or equal to the electron diffusion depth, more than eighty percent (>80%) of the electron energy is deposited directly into the coolant without exceeding the boiling point of the coolant, and wherein said target further comprises a carrier having a mean atomic number of less than 10 supporting the metal foil on the side facing the coolant, further wherein a background of the low-intensity bremsstrahlung X-rays on which quasi-monochromatic characteristic lines of the metal foil are superimposed results in a quasi-monochromatic spectrum of X-rays produced on the side of the metal foil on which the electrons are incident and which is opposite to the side of the base arrangement.

14. The X-ray source as claimed in claim 13, wherein the coolant is water.

15. The X-ray source as claimed in claim 13, wherein said cooling circuit comprises a constriction proximate the metal foil.

* * * * *